US007997344B2

(12) United States Patent
Corbett

(10) Patent No.: US 7,997,344 B2
(45) Date of Patent: Aug. 16, 2011

(54) MULTI-FUNCTION INDICATING TOOL

(75) Inventor: Thomas G. Corbett, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 587 days.

(21) Appl. No.: 11/853,288

(22) Filed: Sep. 11, 2007

(65) Prior Publication Data

US 2009/0065193 A1 Mar. 12, 2009

(51) Int. Cl.
*E21B 33/12* (2006.01)
*E21B 34/12* (2006.01)

(52) U.S. Cl. ..... 166/334.4; 166/387; 166/143

(58) Field of Classification Search ..... 166/51, 166/278, 143, 386, 387
See application file for complete search history.

(56) References Cited

U.S. PATENT DOCUMENTS

| | | | |
|---|---|---|---|
| 3,062,284 | A | 11/1962 | Brown |
| 3,256,937 | A | 6/1966 | Haeber et al. |
| 3,364,996 | A | 1/1968 | Brown |
| 3,913,675 | A | 10/1975 | Smyrl |
| 3,960,366 | A | 6/1976 | Abney et al. |
| 4,286,661 | A | 9/1981 | Gazda |
| 4,364,430 | A | 12/1982 | Szarka |
| 4,440,218 | A | 4/1984 | Farley |
| 4,628,993 | A | 12/1986 | Zunkel |
| 4,633,943 | A | 1/1987 | Zunkel |
| 4,633,944 | A | 1/1987 | Zunkel et al. |
| 4,635,716 | A | 1/1987 | Zunkel |
| 4,638,859 | A | 1/1987 | Zunkel et al. |
| 4,671,352 | A | 6/1987 | Magee, Jr. et al. |
| 4,671,361 | A | 6/1987 | Bolin |
| 4,842,057 | A | 6/1989 | Lubitz |
| 4,913,231 | A | 4/1990 | Muller et al. |
| 4,997,042 | A | 3/1991 | Jordan et al. |
| 5,082,062 | A | 1/1992 | Wood et al. |
| 5,443,117 | A | 8/1995 | Ross |
| 5,609,204 | A | 3/1997 | Rebardi et al. |
| 5,865,251 | A | 2/1999 | Rebardi et al. |
| 6,053,246 | A | 4/2000 | Echols et al. |
| 6,079,496 | A | 6/2000 | Hirth |

(Continued)

FOREIGN PATENT DOCUMENTS

WO 03/080993 A1 10/2003

OTHER PUBLICATIONS

Palar, M., et al., "Fravel Packing Wells Drilled with Oil-Based Fluids: A Critical Review of Current Practices and Recommendations for Future Applications", SPE 89815, Sep. 2004, 1-15.

(Continued)

*Primary Examiner* — Daniel P Stephenson
(74) *Attorney, Agent, or Firm* — Steve Rosenblatt

(57) ABSTRACT

A crossover tool assembly is run in with a packer and after the packer is set it is released from the packer for independent movement. The assembly is picked up to allow spring loaded dogs to come out so that upon setting down weight the crossover assembly has an outer assembly that is supported on the packer mandrel. The crossover mandrel can then be set down and picked up to operate a j-slot mechanism in the crossover. Relative movement induced by the j-slot with the outer assembly of the crossover supported by the dogs allows a return path within the crossover to be opened or closed independent of any contact with the packer mandrel.

13 Claims, 3 Drawing Sheets

U.S. PATENT DOCUMENTS

| | | | | |
|---|---|---|---|---|
| 6,131,663 | A | 10/2000 | Henley et al. | |
| 6,230,801 | B1 | 5/2001 | Hill, Jr. et al. | |
| 6,378,609 | B1 * | 4/2002 | Oneal et al. | 166/278 |
| 6,382,319 | B1 * | 5/2002 | Hill et al. | 166/278 |
| 6,464,006 | B2 | 10/2002 | Womble | |
| 6,494,256 | B1 * | 12/2002 | Achee et al. | 166/51 |
| 6,691,788 | B1 | 2/2004 | Dearing | |
| 6,702,020 | B2 | 3/2004 | Zachman et al. | |
| 7,048,055 | B2 | 5/2006 | Hirth | |
| 7,128,151 | B2 | 10/2006 | Corbett | |
| 7,559,357 | B2 | 7/2009 | Clem | |
| 2002/0195253 | A1 | 12/2002 | Hill, Jr. et al. | |
| 2006/0225878 | A1 | 10/2006 | Coronado | |
| 2007/0284111 | A1 | 12/2007 | Ashy et al. | |
| 2008/0110620 | A1 * | 5/2008 | Penno | 166/278 |
| 2009/0065193 | A1 | 3/2009 | Corbett | |

OTHER PUBLICATIONS

Coronado, Martin P., "Development of a Single-Trip Method for Shallow-Set Casing Shoe Testing and Openhole Drilling", SPE 56498, Oct. 1999, 1-14.

Coronado, Martin P., et al., "Advanced Openhole Completions Utilizing a Simplified Zone Isolation System", SPE 77438, Oct. 2002. 1-11.

* cited by examiner

MULTI-FUNCTION INDICATING TOOL

FIELD OF THE INVENTION

The field of the invention is crossover tools used in conjunction with isolation packers and screens to perform a variety of completion operations such as gravel packing and frac packing.

BACKGROUND OF THE INVENTION

Crossover tools are used in conjunction with isolation packers to allow gravel packing and frac packing (hydraulic fracturing in conjunction with gravel packing). Some designs are run in already positioned to allow fluids pumped through the string to crossover into an annular space outside the screen assembly and to take fluid returns through a wash pipe inside the screens. The returns go back through a discrete path in the crossover and exit into the annular space above the packer.

Another type of crossover is shifted between squeeze and circulate positions by moving it relatively to the seal bores in the packer body. These designs shown in FIGS. 1 and 2 involve putting the tool into a supported position at discrete axially spaced locations using spaced indicating subs and complex collet designs known in the industry as SMART® collets. FIG. 1 shows this type of design. A packer 10 has a seal bore 11, slips 12 and a sealing element 14. It has a seal bore 18 in an extension assembly below it. It also features spaced single indicating sub 20 and double indicating sub 22. At the bottom are the screen sections depicted schematically as 24. The crossover tool assembly 26 is connected at top end 28 to a string that can be manipulated from the surface. Passage 30 is open at ports 31 and 32 for delivery of fracturing fluid to the annular space below packer 10 while return passage 34 is closed at outlet 36 by virtue of seals 35 and 37 sealing in packer bore 11. An initial threaded connection 38 for run in can be undone when the assembly is properly paced and after packer 10 is set. Below the crossover tool 26 is a shifting tool 40 to selectively close sleeve 41 to isolate port 32 when crossover assembly 26 is retrieved from the well. The SMART® collet 42 is below the shifting tool 40 and below that tool is an indicating collet 44 that comes into play during the evacuation position when collet 44 comes up against the bottom of indicating sub 22 and the ports 16 come up above seal bore 18. A j-slot mechanism (not shown) is operative after threaded connection 38 is undone. It can un-support the SMART® collet 42 so that it can clear the indicating sub 22 and be set down on top to define the circulating position shown in FIG. 2. In this position port 36 is open, the SMART® collet 42 is on top of indicating sub 22 and ports 16 are still in seal bore 18. Some of these components and how they operate can be seen in U.S. Pat. No. 6,464,006 FIG. 3.

There are many external seals in the design of FIGS. 1 and 2 and they can be prone to sticking. Another issue with this design especially in very deep wells is that it is difficult to know if the applied pickup force at the surface has translated into a sufficient pickup force at the crossover 26 to have lifted the SMART® collet 42 high enough so that when weight is set down again it will land in the FIG. 2 position. Frequently, the tool position has to be confirmed with an effort to circulate or reverse circulate to be sure the tool has actually obtained the circulation position. Using spaced indicating subs to define the various positions makes for a longer assembly that adds cost and decreased ability to maneuver the assembly in highly deviated wellbores.

Instead of setting down for support below the packer 10 the present invention rests the tool assembly above. It doesn't rely on lifting seals into or out of contact with the packer body to attain the circulating position. Instead, with the crossover supported above the packer a j-slot assembly moves parts relatively within the crossover tool itself to open or close the return path to define the circulation and squeeze positions respectively. The assembly is shorter and expensive parts used for support of the tool in the packer are eliminated. The tool can reliably move back and forth between the squeeze and circulating positions with a simple short pickup and set down movement. Using set down weight on top of the packer directly counters the high pressure forces generated when doing the squeezing than what could be obtained with the FIGS. 1 and 2 designs. These and other aspects of the present invention will become more apparent to those skilled in the art from a review of the description of the preferred embodiment and the associated drawings that appear below while recognizing that the full scope of the invention is to be determined by the appended claims.

SUMMARY OF THE INVENTION

A crossover tool assembly is run in with a packer and after the packer is set it is released from the packer for independent movement. The assembly is picked up to allow spring loaded dogs to come out so that upon setting down weight the crossover assembly has an outer assembly that is supported on the packer mandrel. The crossover mandrel can then be set down and picked up to operate a j-slot mechanism in the crossover. Relative movement induced by the j-slot with the outer assembly of the crossover supported by the dogs allows a return path within the crossover to be opened or closed independent of any contact with the packer mandrel.

DETAILED DESCRIPTION OF THE PREFERRED EMBODIMENT

Figure 3:
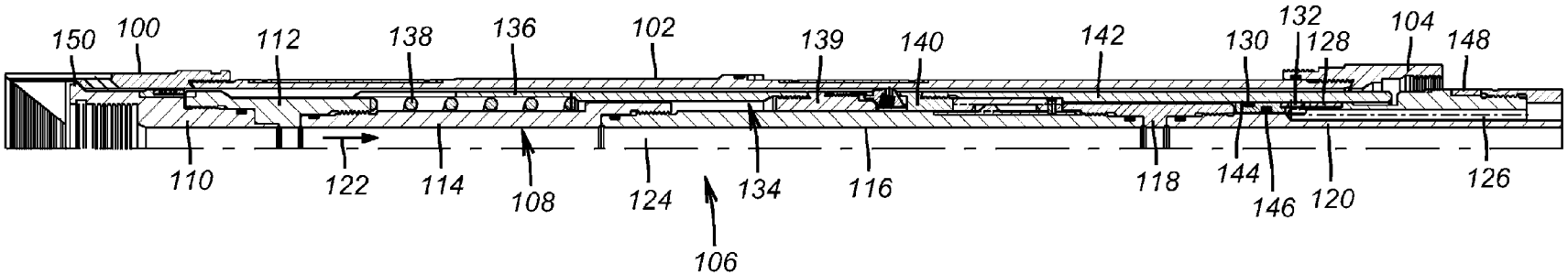
FIG. 3 is a section view of the tool of the present invention shown in the run in position.

FIG. 3 shows a packer body that comprises of a top sub 100 connected to a multi-component body 102 which is in turn connected to a bottom sub 104. The slips and sealing element for the packer are omitted. The crossover tool 106 has a mandrel 108 that starts at top sub 110 that is connected to coupling 112. Next is upper body 114 connected to lower body 116 followed by connector 118 and bottom sub 120. Arrow 122 represents flow that can come from the surface and go through passage 124 and out into the annular space below packer bottom sub 104. Those skilled in the art will appreciate that the annular exit to the outside of a screen assembly is left off the drawings. What is shown is the return path 126 which is discrete from path 124. In the run in position of FIG. 3 path 126 is closed by seals 128 and 130 that straddle ports 132 that are aligned with passage 126.

Figure 1:
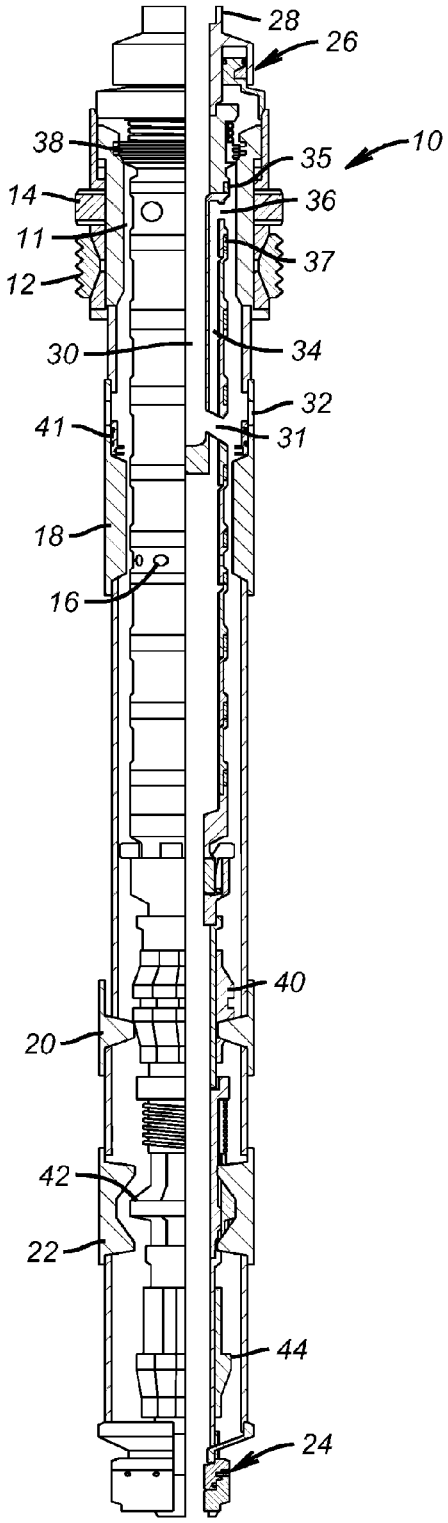
(PRIOR ART) FIG. 1
FIG. 1 is a section view of a prior art crossover that is supported within the packer mandrel and shown in the squeeze position.
Figure 2:
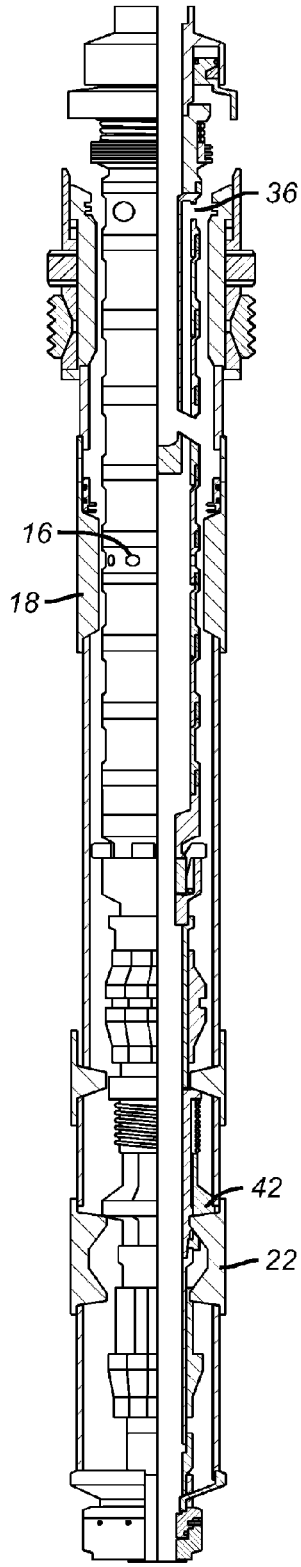
(PRIOR ART) FIG. 2
FIG. 2 is the view of FIG. 1 showing the prior art tool in the circulation position.

The outer assembly 134 comprises sleeve 136 that is biased by spring 138 off of coupling 112. Sleeve 136 is connected to a coupling 139 which is connected to dog retainer 140. Sleeve 142 extends from dog retainer 140. Seal ring 144 is disposed between sleeve 142 and bottom sub 120 and has seals 130 and 146 on it. It is trapped to coupling 118 by virtue of the connection of sub 120 to coupling 118. Sub 120 also has an exterior seal 148, which in the run in position of FIG. 1 is below the packer bottom sub 104. Top sub 110 has a shoulder 150 that is supported by top sub 100 of the packer mandrel for run in. An additional lock between the crossover top sub 110 and the mandrel top sub 100 can be provided in the form of a thread, shear pin or other connection that can be broken or undone by applied pressure or relative rotation, for example.

Figure 4:
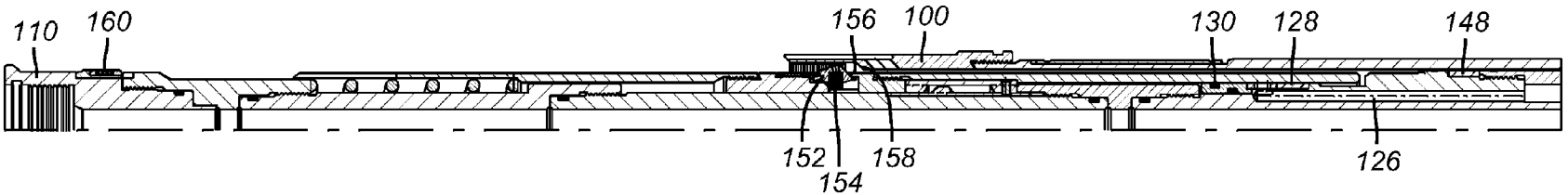
FIG. 4 is the view of FIG. 3 with the tool in an intermediate position before the dogs are set down on the top of the packer mandrel.

To operate the crossover tool relative to the packer body, the two assemblies need to first be released for relative longitudinal movement after the packer has been set in a known manner such as by dropping a ball on a seat and pressuring up. Once released for relative longitudinal movement, the top sub 110 of the crossover tool is picked up as shown in FIG. 4 and away from top sub 100 of the packer body that is now stationary because the packer has been set. After enough lifting, the dogs 152 can be biased radially out by springs 154 until the outward movement of the dogs 152 is stopped by lip 156 on dog retainer 140. In FIG. 4 weight has not been set down yet so the dogs 152 are still above shoulder 158. At this time seal 148 has moved up into packer body 102. Seals 128 and 130 still block passage 126. Bearing 160 on crossover top sub 110 is now also out of the packer body top sub 100.

Figure 5:
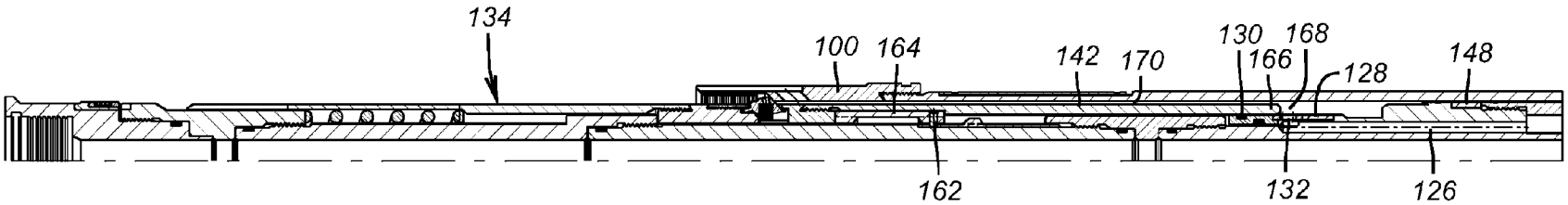
FIG. 5 is the view of FIG. 4 in the circulation position with the dogs set down on top of the packer mandrel.

FIG. 5 shows the dogs 152 landed on packer top sub 100 to now hold the outer assembly 134 in position while the mandrel assembly 108 can be moved down. The mandrel assembly 108 is connected to the outer assembly 134 by a pin 162 that extends from mandrel assembly 108 into a j-slot sleeve 164 mounted to the outer assembly 134. In this position ports 132 are now aligned with a gap 168 at the lower end 166 of sleeve 142 with seals 128 and 130 straddling gap 168. The crossover tool is now in circulating position because return path 126 is sealed into the packer body after ports 132 by seal 148 leaving an exit passage 170 out of the packer body top sub 100 by going around the supported dogs 152. In this position circulation can occur to deposit gravel coming down as shown by arrow 122 and to take returns through the screens (not shown) back up through passage 126 and out into the annulus volume above the packer through passage 170.

Figure 6:
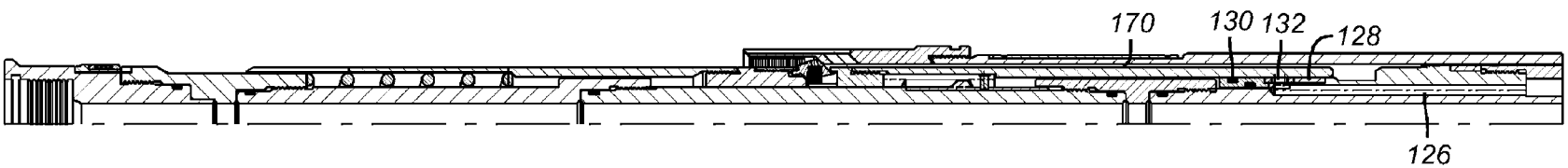
FIG. 6 is the view of FIG. 5 after a j-slot cycling into the squeeze position with the dogs resting on top of the packer mandrel.

FIG. 6 represents a further picking up and setting down of mandrel assembly 108 so that it winds up in a different position due to the j-slot assembly 162 and 164. Now ports 132 are isolated between seals 128 and 130 preventing fluid in passage 126 from getting to exit passage 170. The tool is now in the squeeze position as it was during run in shown in FIG. 3.

Those skilled in the art will appreciate that the present invention finds support above the packer and that the design eliminated various spaced apart indicating subs and a SMART® collet that interacts with them. The overall length of the tool can be shorter than the prior designs and numerous seals and a few seal bores can be eliminated. The j-slot mechanism properly positions the tool with greater accuracy because finding landing points within the packer is no longer required. With the packer set, loading it from the top as opposed to within its mandrel and below its set sealing element also helps to keep the set packer in place against formation pressure. Furthermore, the valve that controls the opening of the return passage 126 is a component of the mandrel assembly 108 and does not interact with the mandrel assembly 108 internal surfaces to open and close, as with the prior art design. While the tool is preferably supported off the top of a packer mandrel, it can be supported from near the top such as from a recess disposed near or extending from the top of the packer mandrel.

The above description is illustrative of the preferred embodiment and many modifications may be made by those skilled in the art without departing from the invention whose scope is to be determined from the literal and equivalent scope of the claims below.

I claim:

1. A multi-position tool for selectively directing flow through a packer mandrel in opposed directions, comprising:

a packer having a packer mandrel and a sealing element, said mandrel being supported at a subterranean location when said element is in the set position;

a crossover tool body comprising relatively movable components and adapted for selective support from adjacent the top of said already independently supported packer mandrel, said crossover tool body while supported from adjacent the top of said packer mandrel is operable to induce relative movement that opens and closes a passage on said crossover tool body.

2. The tool of claim 1, wherein:

said selective support is from the top of the packer mandrel.

3. A multi-position tool for selectively directing flow through a packer mandrel in opposed directions, comprising:

a packer having a packer mandrel;

a body comprising relatively movable components and adapted for selective support from adjacent the top of said packer mandrel, said body while supported from adjacent the top of said packer mandrel is operable to induce relative movement that opens and closes a passage on said body;

said body comprises an inner mandrel with a first flow passage therethough and an outer sleeve assembly relatively movable with respect to said inner mandrel and comprising a second passage that is selectively closed.

4. A multi-position tool for selectively directing flow through a packer mandrel in opposed directions, comprising:

a packer having a packer mandrel;

a body comprising relatively movable components and adapted for selective support from adjacent the top of said packer mandrel to induce relative movement that opens and closes a passage on said body;

said body comprises an inner mandrel with a first flow passage therethough and an outer sleeve assembly relatively movable with respect to said inner mandrel and comprising a second passage that is selectively closed;

said outer sleeve assembly further comprises a movable support that extends when said outer sleeve assembly is retracted from said packer mandrel.

5. The tool of claim 4, wherein:

said outer sleeve assembly is retained to said inner mandrel with a j-slot mechanism.

6. The tool of claim 5, wherein:

said outer sleeve assembly defines an annular space between itself and said packer mandrel;

said second passage in selective communication with said annular passage depending on the relative position of said inner mandrel and said outer sleeve assembly.

7. The tool of claim 6, wherein:

a pair of seals straddle said second passage and close it when they contact said outer sleeve assembly as said outer sleeve assembly overlays said second passage.

8. The tool of claim 7, wherein:

said j-slot assembly repositions said outer sleeve assembly so that at least one said seal is no longer in contact with it to allow fluid communication to said annular space within the packer mandrel.

9. The tool of claim 8, wherein:

said movable support comprises at least one biased dog.

10. The tool of claim 9, wherein:

said inner mandrel is selectively retained to the packer mandrel for run in while said dog is held against said bias within the packer mandrel.

11. The tool of claim 10, wherein:

said inner mandrel is released from the packer mandrel and said dog is biased radially outwardly upon retraction from the packer mandrel, whereupon setting down weight said dog lands on said packer mandrel.

12. The tool of claim 11, wherein:

said dog land on top of said packer mandrel.

13. The tool of claim 12, wherein:

said dog is biased by at least one spring.

* * * * *